US010473120B2

(12) United States Patent
Thawani et al.

(10) Patent No.: US 10,473,120 B2
(45) Date of Patent: Nov. 12, 2019

(54) BLOWER ASSEMBLY HAVING RESONATORS AND RESONATOR ASSEMBLY

(71) Applicants: DENSO International America, Inc., Southfield, MI (US); DENSO CORPORATION, Kariya, Aichi-pref (JP)

(72) Inventors: Prakash Thawani, Bloomfield Hills, MI (US); Steve Sinadinos, Commerce Township, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 324 days.

(21) Appl. No.: 15/453,962

(22) Filed: Mar. 9, 2017

(65) Prior Publication Data

US 2018/0258958 A1 Sep. 13, 2018

(51) Int. Cl.

| | |
|---|---|
| ***F04D 29/66*** | (2006.01) |
| ***F04D 29/42*** | (2006.01) |
| *F04D 29/28* | (2006.01) |

(52) U.S. Cl.

CPC ..... *F04D 29/665* (2013.01); *F04D 29/4226* (2013.01); *F04D 29/66* (2013.01); *F04D 29/663* (2013.01); *F04D 29/282* (2013.01); *F05D 2260/96* (2013.01); *F05D 2270/333* (2013.01)

(58) Field of Classification Search

CPC ..... F04D 29/66; F04D 29/663; F04D 29/665; F04D 29/4226; F04D 29/282; F05D 2260/96; F05D 2270/333

See application file for complete search history.

(56) References Cited

U.S. PATENT DOCUMENTS

| | | | | |
|---|---|---|---|---|
| 3,542,152 A | | 11/1970 | Adamson et al. | |
| 3,848,697 A | * | 11/1974 | Jannot | F02K 1/827 181/220 |
| 4,106,587 A | * | 8/1978 | Nash | F02K 1/827 181/213 |
| 4,135,603 A | * | 1/1979 | Dean, III | G10K 11/172 181/286 |

(Continued)

FOREIGN PATENT DOCUMENTS

| | | |
|---|---|---|
| JP | 2011-099413 A | 5/2011 |
| JP | 2015-212542 A | 11/2015 |

(Continued)

*Primary Examiner* — Nathaniel E Wiehe
*Assistant Examiner* — Andrew J Marien

(57) ABSTRACT

The present disclosure provides a centrifugal blower assembly that includes a centrifugal fan and a scroll casing housing the centrifugal fan. The scroll casing includes a scroll starting position, a scroll ending position and an air passage extending between the scroll starting and ending positions. The scroll ending position is downstream from the scroll starting position relative to airflow through the scroll casing. The centrifugal blower assembly further includes an air outlet extending from the scroll ending position and a plurality of resonators mounted on an exterior surface of the air outlet. Each of the plurality of tuned resonators has respective cavities in fluid communication with inside of the air outlet. Each of the cavities has respective different volumes, heights, widths, and/or lengths from each other.

14 Claims, 4 Drawing Sheets

(56) References Cited

U.S. PATENT DOCUMENTS 4,231,447 A * 11/1980 Chapman ..... F01N 1/02 181/213
5,340,275 A 8/1994 Eisinger
5,560,120 A 10/1996 Swanson et al.
5,707,591 A * 1/1998 Semedard ..... F22B 31/003 165/53
6,171,054 B1 1/2001 Mann, III et al.
6,309,176 B1 10/2001 Periyathamby et al.
6,375,118 B1 * 4/2002 Kibens ..... F02K 1/34 244/1 N
6,379,110 B1 4/2002 McCormick et al.
6,530,221 B1 * 3/2003 Sattinger ..... F01D 25/30 181/213
6,575,696 B1 * 6/2003 Lyons ..... F04D 29/665 415/119
8,272,834 B2 * 9/2012 Lefevre ..... F04D 29/665 415/119
8,783,413 B1 7/2014 Thawani et al.
8,789,372 B2 * 7/2014 Johnson ..... F23R 3/28 60/725
9,011,092 B2 4/2015 Eguchi et al.
9,170,616 B2 10/2015 Beltman et al.
9,193,469 B2 * 11/2015 Bauer ..... B64D 33/06
9,568,017 B2 2/2017 Hayashi et al.
2001/0018022 A1 8/2001 Nakamura
2003/0116377 A1 6/2003 Huhn et al.
2003/0183446 A1 10/2003 Shah et al.
2004/0071546 A1 * 4/2004 Werner ..... A47L 9/0081 415/119
2005/0207883 A1 9/2005 Shufeldt
2005/0284690 A1 * 12/2005 Proscia ..... F02C 7/045 181/214
2006/0000220 A1 * 1/2006 Sattinger ..... F02C 7/222 60/776
2007/0281600 A1 12/2007 Thawani et al.
2007/0292261 A1 12/2007 Tang et al.
2009/0308685 A1 12/2009 Gorny et al.
2010/0189547 A1 7/2010 Shirahama et al.
2011/0200426 A1 8/2011 Takano
2014/0013756 A1 * 1/2014 Melton ..... F02C 7/22 60/725
2014/0020975 A1 * 1/2014 Konig ..... F01D 1/06 181/213
2014/0271132 A1 9/2014 Le Roy et al.
2015/0125268 A1 * 5/2015 Koopmann ..... B64C 11/001 415/119
2015/0192135 A1 7/2015 Eguchi et al.
2015/0275900 A1 10/2015 Chen
2015/0292521 A1 10/2015 Wu et al.
2015/0316070 A1 11/2015 Hayashi et al.
2015/0369514 A1 12/2015 Groskreutz et al.
2016/0208816 A1 7/2016 Sawyer

FOREIGN PATENT DOCUMENTS

WO 1981003201 A1 11/1981
WO 1993002445 A1 2/1993
WO 2009071270 A1 6/2009
WO 2013124939 A1 8/2013

* cited by examiner

BLOWER ASSEMBLY HAVING RESONATORS AND RESONATOR ASSEMBLY

FIELD

The present disclosure relates to a centrifugal blower assembly for a vehicle.

BACKGROUND

This section provides background information related to the present disclosure which is not necessarily prior art.

A blower assembly has been provided for a heating, ventilation, and air conditioning (HVAC) unit for a vehicle or any industrial applications. One of the conventional blower assemblies may include a centrifugal fan and a scroll casing. The centrifugal fan may define an air inlet at a center thereof for receipt of airflow. The centrifugal fan may define a plurality of air outlets about an outer periphery thereof. A plurality of blades may be provided at the air outlets in order to direct airflow exiting the air outlets. The centrifugal fan may rotate about an axis at an axial center of the air inlet.

The scroll casing may include a side scroll casing, generally extending around a portion of the centrifugal fan from a scroll starting position to a scroll ending position. An air outlet of the blower assembly may extend from the scroll ending position to an outlet aperture at which airflow exits the blower assembly. The air outlet may define the outlet aperture. As airflow may pass through such blower assembly, various noises may occur such as an air-rush noise. The air-rush noise may be dominated by a high frequency broad-band noise in the frequency range of about 1500 Hertz to about 6000 Hertz. Major source may be the turbulence induced noise and location of this noise may be in the air outlet of the blower assembly.

SUMMARY

This section provides a general summary of the disclosure, and is not a comprehensive disclosure of its full scope or all of its features.

An aspect of the present disclosure provides a centrifugal blower assembly that includes a centrifugal fan and a scroll casing housing the centrifugal fan. The centrifugal fan defines an air inlet at a center of the centrifugal fan, a plurality of air outlets at an outer periphery of the centrifugal fan, and a plurality of blades at the air outlets. The scroll casing includes a scroll starting position, a scroll ending position and an air passage extending between the scroll starting and ending positions. The scroll ending position is downstream from the scroll starting position relative to airflow through the scroll casing. The centrifugal blower assembly further includes an air outlet extending from the scroll ending position and a plurality of resonators mounted on an exterior surface of the air outlet. Each of the plurality of resonators has respective cavities in fluid communication with inside of the air outlet. Each of the cavities has respective different volumes, heights, widths, and/or lengths from each other.

Another aspect of the present disclosure provides a resonator assembly for a centrifugal blower assembly that includes a first resonating portion having a first cavity and a second resonating portion having a second cavity. The first resonating portion is to be mounted on a first stub that is formed in a scroll casing. The first cavity is to be in fluid communication with inside of the scroll casing. The second resonating portion is to be mounted on a second stub that is formed in the scroll casing. The second cavity is to be in fluid communication with inside of the scroll casing. The first and second resonating portions are integrated into one single bunch assembly such that the first and second stubs are to be fitted in the first and second cavities, respectively. Each of the cavities has respective different volumes, heights, widths, and/or lengths from each other.

Further areas of applicability will become apparent from the description provided herein. The description and specific examples in this summary are intended for purposes of illustration only and are not intended to limit the scope of the present disclosure.

DRAWINGS

The above and other objects, features and advantages of the present invention will become more apparent from the following detailed description made with reference to the accompanying drawings. The drawings described herein are for illustrative purposes only of selected embodiments and not all possible implementations, and are not intended to limit the scope of the present disclosure.

DETAILED DESCRIPTION

Figure 1:
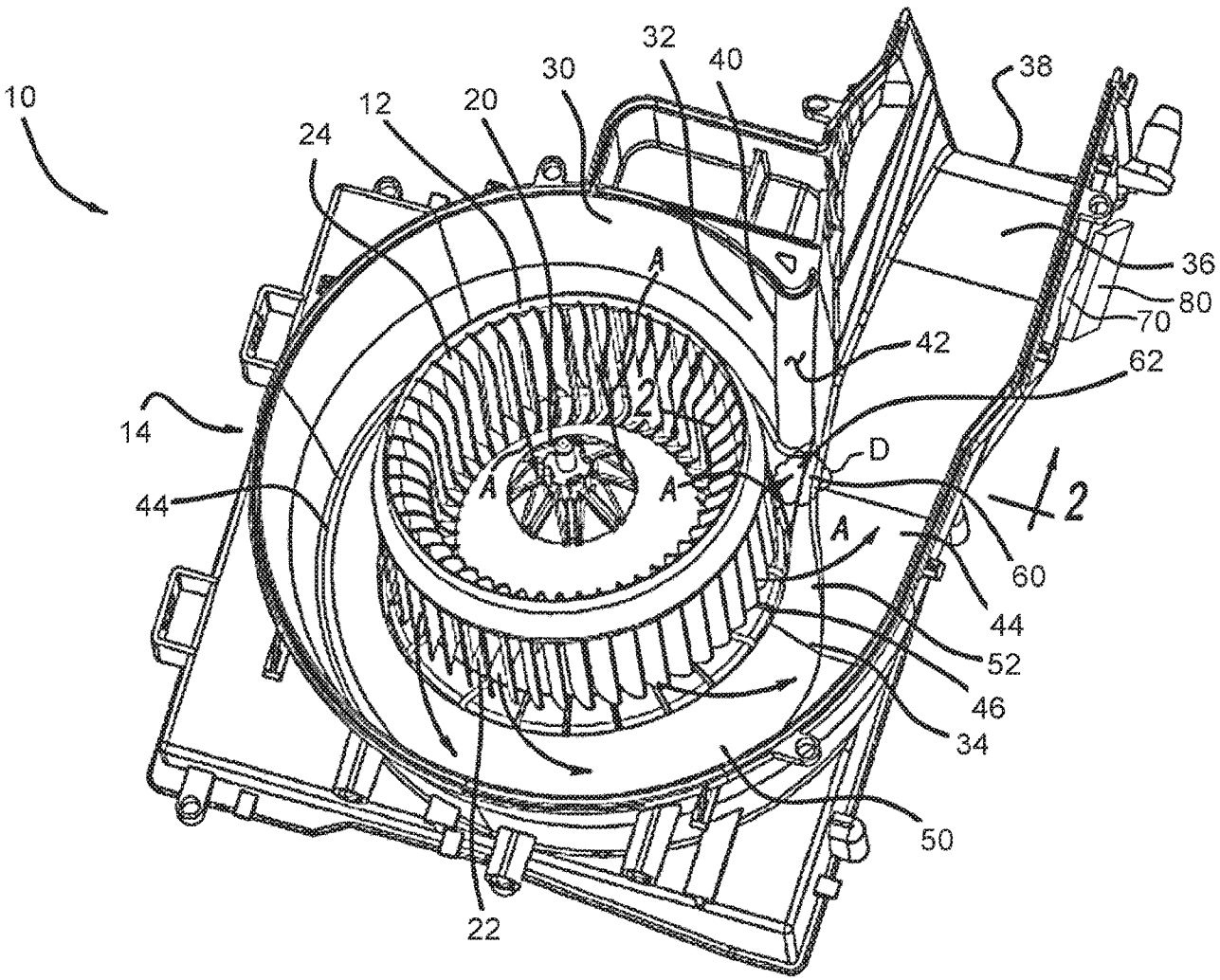
FIG. 1 is a perspective view of a blower assembly according to the first embodiment.

A plurality of embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts may be combined. The embodiments may be partially combined even if it is not explicitly described that the embodiments may be combined, provided there is no harm in the combination.

First Embodiment

Figure 2:
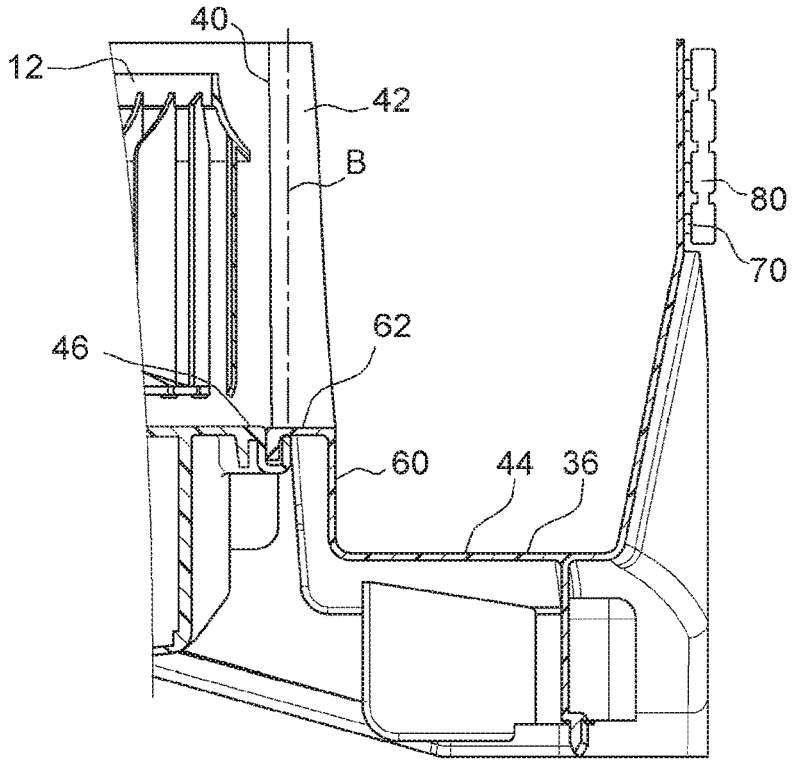
FIG. 2 is a cross-sectional view of the blower assembly taken along line 2-2 of FIG. 1.

Configuration of a blower assembly 10 according to the first embodiment will be described. FIG. 1 depicts a perspective view of the blower assembly 10 according to the present embodiment. FIG. 2 depicts a cross-sectional view of the blower assembly 10 taken along line 2-2 of FIG. 1.

The blower assembly 10 includes a centrifugal fan 12 and a scroll casing 14. The centrifugal fan 12 defines an air inlet 20 at a center thereof for receipt of airflow A. The centrifugal fan 12 defines a plurality of air outlets 22 about an outer periphery thereof. The centrifugal fun 12 has a plurality of blades 24. The plurality of blades 24 are provided at the air outlets 22 in order to direct airflow A exiting the air outlets 22. The centrifugal fan 12 rotates about an axis at an axial center of the air inlet 20.

The scroll casing 14 includes a side scroll casing 30, extending around a portion of the centrifugal fan 12 from a scroll starting position 32 to a scroll ending position 34. An air outlet 36 of the blower assembly 10 extends from the scroll ending position 34 to an outlet aperture 38 at which airflow A exits the blower assembly 10. The air outlet 36 defines the outlet aperture 38.

A window 40 is defined between the side scroll casing 30 and the centrifugal fan 12 proximate to the scroll starting position 32. At the scroll starting position 32 is a partition 42, which at least partially defines the window 40. The partition 42 separates or partitions the side scroll casing 30 from the air outlet 36, and can be any suitable partition, such as a vertical partition or nose. The partition 42 extends vertically, such as along line B, as illustrated in FIG. 2, relative to a lower surface 44 of the scroll casing 14.

The lower surface 44 of the scroll casing 14 is recessed below a ring-shaped planar face 46. The ring-shaped planar face 46 at least partially defines a central aperture at which the centrifugal fan 12 is seated. The ring-shaped planar face 46 thus surrounds the centrifugal fan 12. The ring-shaped planar face 46 and the lower surface 44 of the scroll casing 14 extend in parallel and spaced apart planes, with the ring-shaped planar face 46 extending in a plane above the lower surface 44, as particularly illustrated in the orientation of FIG. 2.

Extending between the ring-shaped planar face 46 and the lower surface 44 is a sloped face 50. The sloped face 50 extends directly from the ring-shaped planar face 46, or from an intermediate surface (not shown) therebetween, which is angled or sloped toward the lower surface 44. The sloped face 50 slopes radially outward from the ring-shaped planar face 46 (or the intermediate surface) to the lower surface 44 at a constant slope in an area between the scroll starting position 32 and the scroll ending position 34.

The sloped face 50 includes a sloped transition portion 52 extending beyond the scroll ending position 34 in the direction of the outlet aperture 38, which is a downstream direction relative to airflow A flowing through the scroll casing 14 out from within the centrifugal fan 12. The sloped transition portion 52 angles radially inward towards the centrifugal fan 12 as the sloped transition portion 52 extends away from the scroll ending position 34 in the downstream direction. The sloped transition portion 52 extends to a vertical sidewall 60, which begins proximate to the partition 42, as illustrated in FIG. 1, or downstream of the partition 42 closer to the outlet aperture 38.

A planar guide wall or surface 62 extends from the ring-shaped planar face 46 towards the partition 42. An outer edge of the planar guide surface 62 proximate to the air outlet 36 extends from the ring-shaped planar face 46 in a tangential direction to the partition 42. Thus at the partition 42, the planar guide surface 62 extends in a plane that is perpendicular to line B extending along a height of the partition 42, as illustrated in FIG. 2.

As airflow A exits the air outlets 22, such as proximate to the partition 42, airflow A contacts the planar guide surface 62 and or the partition 42, thereby causing an airflow disruption D. The airflow disruption D generates an undesirable sound. In this present embodiment, the blower assembly 10 includes a resonator assembly 80 that suppresses or minimizes broad-band noises, such as the airflow disruption D, and sounds associated therewith.

To attach the resonator assembly 80 to the air outlet 36, the scroll casing 14 has a plurality of stubs 70 that is formed in the air outlet 36. In this present embodiment, each of the plurality of stubs 70 is in the cylindrical, elliptical or rectangular shape. The plurality of stubs 70 is formed at a bottom surface of the air outlet 36. The bottom surface of the air outlet 36 is on an opposite side to the centrifugal fan 12. In other words, the bottom surface of the air outlet 36 is on an opposite side to the side scroll casing 30. The plurality of stubs 70 is protruded outward from the air outlet 36.

The plurality of stubs 70 includes a first stub 71, a second stub 72, a third stub 73, and a fourth stub 74. The first, second, third and fourth stubs 71, 72, 73, 74 have a first opening 71*a*, a second opening 72*a*, a third opening 73*a*, and a fourth opening 74*a*, respectively. The first, second, third and fourth openings 71*a*, 72*a*, 73*a*, 74*a* pass through the first, second, third and fourth stubs 71, 72, 73, 74, respectively, in fluid connection with airflow which flows in the air outlet 36. Moreover, the first, second, third and fourth stubs 71, 72, 73, 74 have a first flange 71*b*, a second flange 72*b*, a third flange 73*b*, and a fourth flange 74*b*, respectively. The first, second, third and fourth flanges 71*b*, 72*b*, 73*b*, 74*b* are formed at protruding ends of the first, second, third and fourth stubs 71, 72, 73, 74, respectively. The first, second, third and fourth flanges 71*b*, 72*b*, 73*b*, 74*b* expand in radial directions of the first, second, third and fourth stubs 71, 72, 73, 74, respectively.

Figure 3:
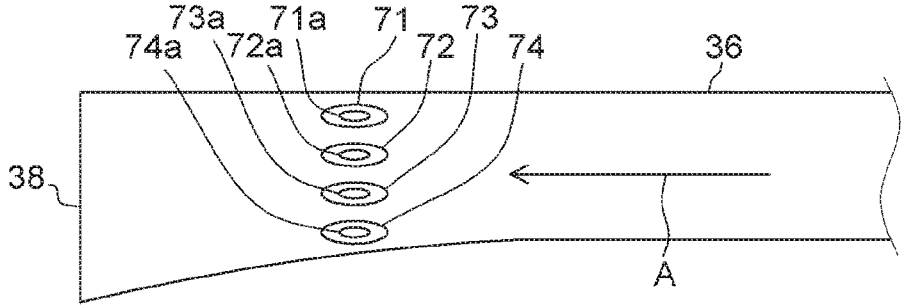
FIG. 3 is a bottom view of the blower assembly before mounting a resonator assembly according to the first embodiment.

FIG. 3 depicts a bottom view of the blower assembly 10 before mounting the resonator assembly 80 according to the present embodiment. Referring to FIG. 3, each cross-section of the first, second, third and fourth stubs 71, 72, 73, 74 is in a circular, elliptical or rectangular shape. Furthermore, each cross-section of the first, second, third and fourth openings 71*a*, 72*a*, 73*a*, 74*a* is in a circular, elliptical or rectangular shape. In other words, each of the first, second, third and fourth stubs 71, 72, 73, 74 is in a cylindrical, elliptical or rectangular shape and hollow. The first, second, third and fourth stubs 71, 72, 73, 74 are disposed in a line perpendicular to airflow A in the air outlet 36. Moreover, the first, second, third and fourth stubs 71, 72, 73, 74 are separated or isolated from each other. In this present embodiment, the first, second, third and fourth stubs 71, 72, 73, 74 are disposed closer to the outlet aperture 38 than to the partition 42.

Figure 4:
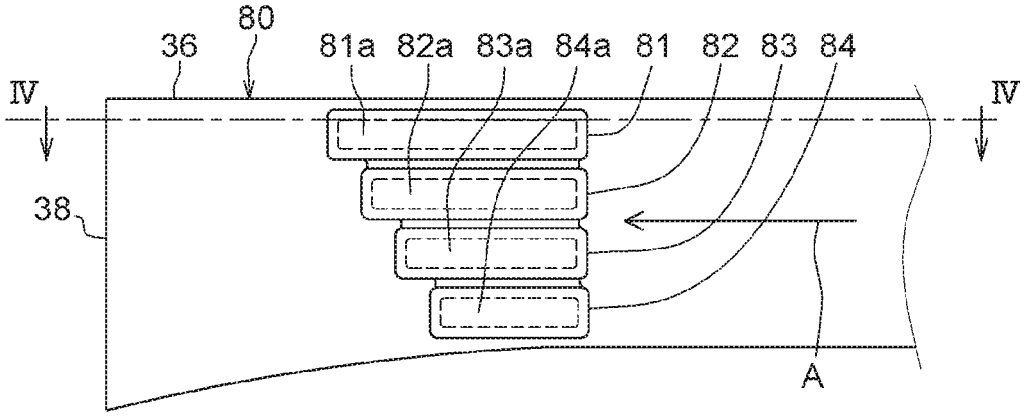
FIG. 4 is a bottom view of the blower assembly after mounting the resonator assembly according to the first embodiment.
Figure 5:
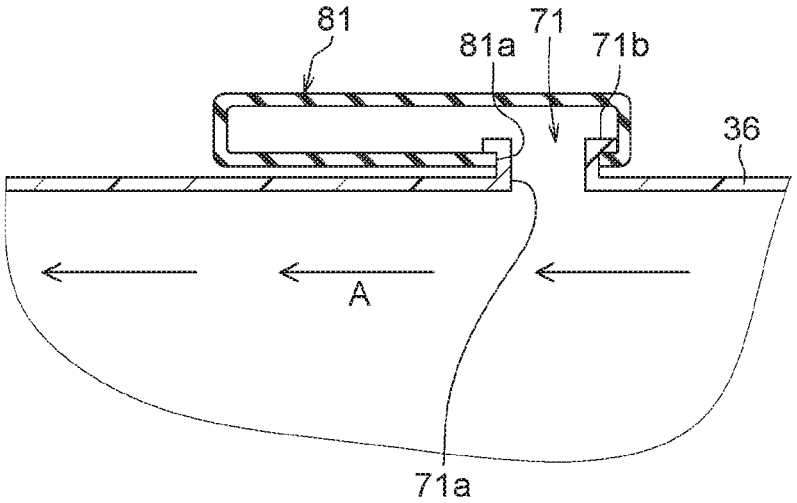
FIG. 5 is a cross-sectional view showing the blower assembly according to the first embodiment.
Figure 6:
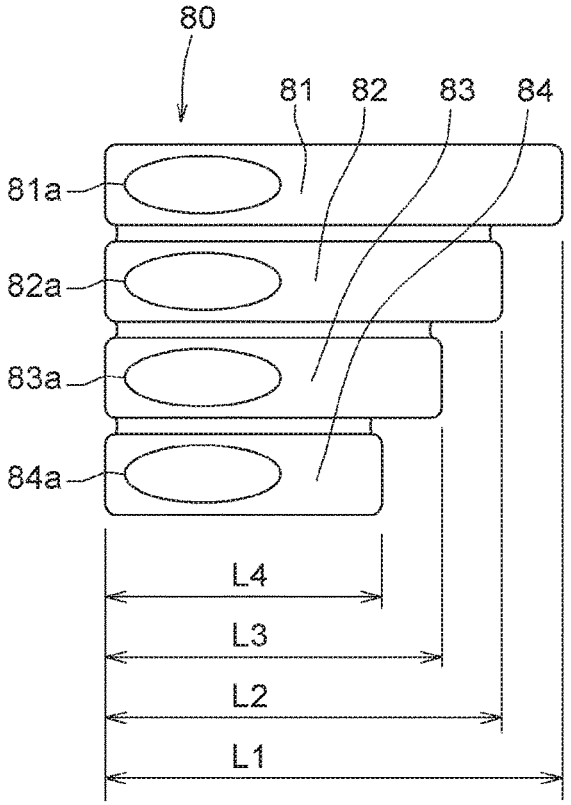
FIG. 6 is a plain view of the resonator assembly according to the first embodiment.

FIG. 4 depicts a bottom view of the blower assembly 10 after mounting the resonator assembly 80 according to the present embodiment. FIG. 5 depicts a cross-sectional view showing the blower assembly 10 according to the present embodiment. Furthermore, FIG. 6 depicts a plain view of the resonator assembly 80 according to the present embodiment.

Referring to FIG. 4, the resonator assembly 80 is disposed on the bottom surface of the air outlet 36. In this present embodiment, the resonator assembly 80 is made of rubber. The resonator assembly 80 is in a bunch shape and has a plurality of resonating portions 81, 82, 83, 84, integrally. Each of the plurality of resonating portions 81, 82, 83, 84 has respective cavities 81*a*, 82*a*, 83*a*, 84*a* therein, separately. Each of the cavities 81*a*, 82*a*, 83*a*, 84*a* has respective different volumes, heights, widths, and/or lengths from each other to suppress or minimize broad-band high frequency noises, such as the airflow disruption D. In other words, the resonator assembly 80 has multi-length resonating portions 81, 82, 83, 84 to suppress the broad-band noises in the frequency range of 1500 Hertz to 6000 Hertz, such as an air-rush noise.

In this embodiment, the plurality of resonating portions 81, 82, 83, 84 includes a first resonating portion 81 having a first cavity 81*a*, a second resonating portion 82 having a second cavity 82*a*, a third resonating portion 83 having a third cavity 83*a*, and a fourth resonating portion 84 having a fourth cavity 84*a*. Each of the first, second, third and fourth resonating portions 81, 82, 83, 84 is in a bar shape and hollow. The first, second, third and fourth resonating portions 81, 82, 83, 84 have the same thickness, and extend along a direction of airflow A. The first, second, third and fourth resonating portions 81, 82, 83, 84 are stacked in a line, and have respective different extending lengths from each other so that each of the first, second, third and fourth cavities 81*a*, 82*a*, 83*a*, 84*a* has the respective different volumes from each other.

For example, the first resonating portion 81 is the longest in all of them so that the first cavity 81*a* is the largest volume in all of them. On the other hand, the fourth resonating portion 84 is the shortest in all of them so that the fourth cavity 84*a* is the smallest in all of them. The first, second, third and fourth resonating portions 81, 82, 83, 84 are integrated in one single bunch assembly. The first resonating portion 81 and the fourth resonating portion 84 are located at ends in a direction perpendicular to airflow A. The second resonating portion 82 and the third resonating portion 83 are located at the middle in the direction perpendicular to airflow A.

Referring to FIG. 5, the first, second, third and fourth resonating portions 81, 82, 83, 84 are mounted on the first, second, third and fourth stubs 71, 72, 73, 74, respectively. The first, second, third and fourth resonating portions 81, 82, 83, 84 have respective upstream-side ends at the same position in the direction of airflow A. Each of the first, second, third and fourth cavities 81*a*, 82*a*, 83*a*, 84*a* opens at the respective upstream-side ends.

The first, second, third and fourth resonating portions 81, 82, 83, 84 fit the first, second, third and fourth stubs 71, 72, 73, 74 in the first, second, third and fourth cavities 81*a*, 82*a*, 83*a*, 84*a*, respectively. In this present embodiment, the first, second, third and fourth cavities 81*a*, 82*a*, 83*a*, 84*a* have respective recesses in accordance with outer shapes of the flanges 71*b*, 72*b*, 73*b*, 74*b* to snap-fit the respective flanges in the respective recesses. Each of the first, second, third and fourth cavities 81*a*, 82*a*, 83*a*, 84*a* is in fluid communication with the airflow that flow in the air outlet 36 via the respective openings 71*a*, 72*a*, 73*a*, 74*a*.

In this present embodiment, the first, second, third and fourth resonating portions 81, 82, 83, 84 are detached from the bottom surface of the air outlet 36. An interior surface of the air outlet 36, which is an opposite surface to the plurality of stubs 70, is plane not to disturb airflow A. The resonator assembly 80 is deformable in such a way that the plurality of the stubs 70 is capable to be inserted into the respective cavities 81*a*, 82*a*, 83*a*, 84*a*.

Referring to FIG. 6, the first, second, third and fourth cavities 81*a*, 82*a*, 83*a*, 84*a* have respective openings that are disposed in a line in accordance with the plurality of the stubs 70. Each opening of the first, second, third and fourth cavities 81*a*, 82*a*, 83*a*, 84*a* is in a circular, elliptical or rectangular shape. The first, second, third and fourth resonating portions 81, 82, 83, 84 are connected with each other by connecting portions, which are disposed in each gap of them.

As illustrated in FIG. 6, the first resonating portion 81 has a length L1, the second resonating portion 82 has a length L2, the third resonating portion 83 has a length L3, and the fourth resonating portion 84 has a length L4 such that the lengths L1, L2, L3, L4 are defined in accordance with FORMULA 1.

$$L1>L2>L3>L4 \quad \text{[FORMULA 1]}$$

The first, second, third and fourth cavities 81*a*, 82*a*, 83*a*, 84*a* are configured to resonate with the respective different high frequency noises to suppress or minimize the respective noises corresponding to the lengths L1, L2, L3, L4. In other words, each of the first, second, third and fourth cavities 81*a*, 82*a*, 83*a*, 84*a* has the respective different volume from each other to provide to suppress or minimize the respective noises by resonating. Thereby, the resonator assembly 80 can suppress the broad-band and even narrowband (blade passing tone) high frequency noises.

Second Embodiment

Figure 7:
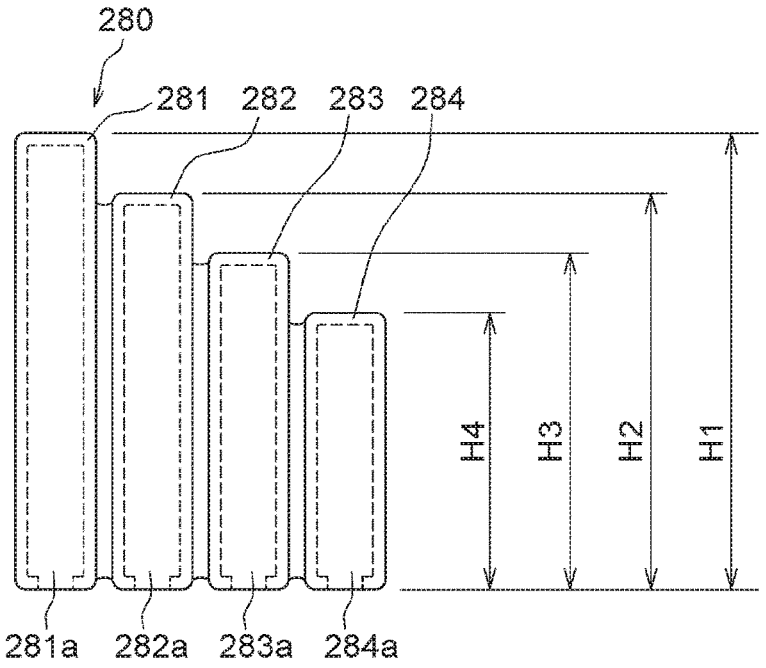
FIG. 7 is a front view of a resonator assembly according to the second embodiment.

Different aspect of the second embodiment from the first embodiment will be described mainly with reference to FIG. 7. Configuration of a resonator assembly 280 according to the second embodiment will be described. FIG. 7 depicts a front view of the resonator assembly 280 according to the present embodiment.

Referring to FIG. 7, the resonator assembly 280 is disposed on the bottom surface of the air outlet 36. In this present embodiment, the resonator assembly 280 is made of rubber. The resonator assembly 280 has in a bunch shape and has a plurality of resonating portions 281, 282, 283, 284, integrally. Each of the plurality of resonating portions 281, 282, 283, 284 has respective cavities 281*a*, 282*a*, 283*a*, 284*a* therein, separately. Each of the cavities 281*a*, 282*a*, 283*a*, 284*a* has respective different volumes from each other to suppress or minimize broad-band high frequency noises. In other words, the resonator assembly 280 has multi-height resonating portions 281, 282, 283, 284 to suppress the broad-band noises in the frequency range of 1500 Hertz to 6000 Hertz.

In this embodiment, the plurality of resonating portions 281, 282, 283, 284 includes a first resonating portion 281 having a first cavity 81*a*, a second resonating portion 282 having a second cavity 82*a*, a third resonating portion 283 having a third cavity 83*a*, and a fourth resonating portion 284 having a fourth cavity 84*a*. Each of the first, second, third and fourth resonating portions 281, 282, 283, 284 is in a bar shape and hollow. The first, second, third and fourth resonating portions 281, 282, 283, 284 have the same thickness, and extends along perpendicular to the direction of airflow A. The first, second, third and fourth resonating portions 281, 281, 283, 284 are stacked in a line, and have respective different extending heights from each other so that each of the first, second, third and fourth cavities 281*a*, 282*a*, 283*a*, 284*a* has respective different volumes from each other.

The first, second, third and fourth resonating portions 281, 282, 283, 284 have a first cavity 281*a*, a second cavity 282*a*, a third cavity 283*a*, and a fourth cavity 284*a*, respectively, at respective bottoms thereof. The first, second, third and fourth resonating portions 281, 282, 283, 284 fit the first, second, third and fourth stubs 71, 72, 73, 74 in the first, second, third and fourth cavities 281*a*, 282*a*, 283*a*, 284*a*, respectively. Thereby, each of the first, second, third and fourth cavities 281*a*, 282*a*, 283*a*, 284*a* is in fluid communication with the airflow that flow in the air outlet 36 via the respective openings 71*a*, 72*a*, 73*a*, 74*a* of the stubs 71, 72, 73, 74.

The resonator assembly 280 is deformable in such a way that the plurality of the stubs 70 is capable to be inserted into the respective cavities 281*a*, 282*a*, 283*a*, 284*a*. The first, second, third and fourth resonating portions 281, 282, 283, 284 are connected with each other by connecting portions, which are disposed in each gap of them.

As illustrated in FIG. 6, the first resonating portion 281 has a height H1, the second resonating portion 282 has a height H2, the third resonating portion 283 has a height H3, and the fourth resonating portion 284 has a height H4 such that the heights H1, H2, H3, H4 are defined in accordance with FORMULA 2.

$$H1>H2>H3>H4 \quad \text{[FORMULA 2]}$$

The first, second, third and fourth cavities 281*a*, 282*a*, 283*a*, 284*a* are configured to resonate with the respective different high frequency noises to suppress or minimize the respective noises corresponding to the heights H1, H2, H3, H4. In other words, each of the first, second, third and fourth cavities 281*a*, 282*a*, 283*a*, 284*a* has the respective different volume from each other to provide to suppress or minimize the respective noises by resonating. Thereby, the resonator assembly 280 can suppress the broad-band and even narrowband (blade passing tone) high frequency noises.

Other Embodiments

In the first embodiment, the plurality of stubs 70 is formed at the bottom surface of the air outlet 36. However, the plurality of stubs is not limited to such a structure. The plurality of the stubs may be formed anywhere of the scroll casing, such as side walls of the air outlet, a top surface of the air outlet, etc.

In the first embodiment, the plurality of stubs 70 includes the first, second, third and fourth stubs 71, 72, 73, 74. Furthermore, the resonator assembly 80 includes the first, second, third and fourth resonating portions 81, 82, 83, 84. However, the number of the stub and the number of the resonating portion are not limited to four. The numbers of the stub and the resonating portion may be two or more as long as the number of the stub is the same to the number of the resonating portion.

In the first embodiment, the first, second, third and fourth stubs 71, 72, 73, 74 have the first, second, third and fourth flanges 71*b*, 72*b*, 73*b*, 74*b*, respectively. However, the first, second, third and fourth stubs are not limited such a structure. The first, second, third and fourth stubs may have no flanges.

In the first embodiment, the resonator assembly 80 is made of rubber. However, the resonator assembly is not limited to such a material. The resonator assembly may be made of plastic.

In the first embodiment, the scroll casing 14 has the plurality of stubs 70 formed in the air outlet 36. However, the scroll casing is not limited such a structure. The scroll casing may have no stubs. The scroll casing may have a plurality of openings formed in the air outlet instead. In such a structure, the resonator assembly may have a plurality of protrusions in accordance with the plurality of openings to attach the resonator assembly thereon. The resonator assembly may have a plurality of cavities in fluid communication with the airflow that flows in the air outlet.

In the first embodiment, the resonator assembly 80 has in a bunch shape so that the plurality of resonating portions 81, 82, 83, 84 are integrated each other. However, resonating means for resonating with the respective different high frequency noises, such as the resonator assembly 80, is not limited such a structure. The resonating means may include a first resonator and a second resonator separately from each other instead of such a bunch-shaped assembly. In such a structure, the first resonator and the second resonator may have in respective different shapes.

In the first embodiment, the plurality of resonating portions 81, 82, 83, 84 has respective different lengths. However, the plurality of resonating portions is not limited such a structure. The plurality of resonating portions may have respective different widths instead of respective different lengths so that a plurality of cavities formed in the plurality of resonating portions may have respective different volumes from each other. Furthermore, the plurality of resonating portions may have respective different widths, respective different lengths, and respective different heights from each other.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A centrifugal blower assembly comprising:

a centrifugal fan defining an air inlet at a center of the centrifugal fan, a plurality of air outlets at an outer periphery of the centrifugal fan, and a plurality of blades at the air outlets;

a scroll casing housing the centrifugal fan, the scroll casing including a scroll starting position, a scroll ending position and an air passage extending between the scroll starting and ending positions, the scroll ending position being downstream from the scroll starting position relative to airflow through the scroll casing;

an air outlet extending from the scroll ending position; and a plurality of resonators mounted on an exterior surface of the air outlet, each of the plurality of resonators having respective cavities in fluid communication with inside of the air outlet, wherein each of the cavities has respective different volumes from each other, the scroll casing has a plurality of stubs formed in the air outlet, the plurality of stubs protruding outward from the air outlet, each of the plurality of stubs has respective openings, each of the openings passing through the plurality of stubs, respectively, each of the plurality of the stubs fits in the respective cavities so that each of the openings is in fluid communication with the respective cavities, each of the plurality of stubs is in a cylindrical, elliptical or rectangular shape and hollow, and the plurality of stubs has respective flanges that expand in respective radial directions thereof.

2. The centrifugal blower assembly according to claim 1, wherein the air outlet defines an outlet aperture, the outlet aperture being disposed on the most downstream side, and the plurality of resonators is disposed near the outlet aperture.

3. The centrifugal blower assembly according to claim 1, wherein the plurality of resonators extends from the plurality of stubs along an extending direction of the air outlet, respectively; and the plurality of resonators has respective different lengths from each other.

4. The centrifugal blower assembly according to claim 1, wherein the plurality of resonators extends from the plurality of stubs along an extending direction of the air outlet, respectively; and the plurality of resonators has respective different heights from each other.

5. The centrifugal blower assembly according to claim 1, wherein the plurality of resonators extends from the plurality of stubs toward perpendicular to an extending direction the air outlet, respectively; and the plurality of resonators has respective different widths from each other.

6. The centrifugal blower assembly according to claim 1, wherein the plurality of resonators is integrated into one single bunch assembly.

7. The centrifugal blower assembly according to claim 1, wherein the plurality of resonators is separate from each other.

8. The centrifugal blower assembly according to claim 1, wherein the plurality of resonators are made of rubber.

9. The centrifugal blower assembly according to claim 1, wherein the scroll casing has a plurality of openings formed in the air outlet, the plurality of openings passing through the air outlet, and the plurality of resonators has respective protrusions in accordance with the plurality of openings to insert the plurality of protrusions into the respective openings.

10. A resonator assembly for a centrifugal blower assembly comprising:

a first resonating portion having a first cavity, to be mounted on a first stub that is formed in a scroll casing and, to be in fluid communication with inside of the scroll casing; and a second resonating portion having a second cavity, to be mounted on a second stub that is formed in the scroll casing and, to be in fluid communication with inside of the scroll casing; wherein the first and second resonating portions are integrated into one single bunch assembly such that the first and second stubs are to be fitted in the first and second cavities, respectively, each of the cavities has respective different volumes from each other;

the first and second stubs have a first opening and a second opening respectively, the first and second openings passing through the first and second stubs respectively, the first and second stubs fit in the first and second cavities respectively so that each of the first and second openings is in fluid communication with the respective cavities, each of the first and second stubs is in a cylindrical, elliptical or rectangular shape and hollow, and the first and second stubs have a first flange and a second flange respectively, the first and second flanges expanding in respective radial directions thereof.

11. The resonator according to claim 10, wherein each of the first and second resonating portions is in a bar shape and hollow, and the first and second resonating portions have respective different lengths from each other.

12. The resonator according to claim 10, wherein each of the first and second resonating portions is in a bar shape and hollow, and the first and second resonating portions have respective different heights from each other.

13. The resonator according to claim 10, wherein each of the first and second resonating portions is in a bar shape and hollow, and the first and second resonating portions have respective different widths from each other.

14. The resonator according to claim 10, wherein the first and second resonating portions are made of rubber.

* * * * *